United States Patent [19]

Burrows

[11] Patent Number: 5,071,595

[45] Date of Patent: Dec. 10, 1991

[54] WATER CARBONATOR SYSTEM

[75] Inventor: Bruce D. Burrows, Valencia, Calif.

[73] Assignee: Ebtech, Inc., Columbus, Ohio

[21] Appl. No.: 562,244

[22] Filed: Aug. 3, 1990

[51] Int. Cl.[5] ..... B01F 3/04

[52] U.S. Cl. ..... 261/140.1; 261/91; 261/DIG. 7; 366/315

[58] Field of Search ..... 261/91, DIG. 7, 140.1; 366/315, 316

[56] References Cited

U.S. PATENT DOCUMENTS

| | | | |
|---|---|---|---|
| Re. 32,179 | 6/1986 | Sedam et al. . | |
| 547,816 | 10/1895 | Stewart . | |
| 1,055,648 | 3/1913 | Murphy . | |
| 1,682,385 | 8/1928 | Leibing . | |
| 1,917,927 | 7/1933 | Denslow . | |
| 1,943,820 | 1/1934 | Goosmann . | |
| 2,391,003 | 12/1945 | Bowman . | |
| 2,626,135 | 1/1953 | Semer | 366/316 |
| 2,650,808 | 9/1953 | Cohen et al. . | |
| 2,729,545 | 1/1956 | Reman et al. | 366/315 |
| 2,850,213 | 9/1958 | Cole . | |
| 3,013,866 | 12/1961 | Samaniego et al. | 366/315 |
| 3,074,700 | 1/1963 | Buttner, Sr. et al. . | |
| 3,088,716 | 5/1963 | Stott | 366/315 |
| 3,243,128 | 3/1966 | Tight | 366/315 |
| 3,259,273 | 7/1966 | Kromer . | |
| 3,298,618 | 1/1967 | Talpey | 366/315 |
| 3,312,083 | 4/1967 | Scroggins . | |
| 3,386,261 | 6/1968 | Cornelius . | |
| 3,730,500 | 5/1973 | Richards . | |
| 3,926,342 | 12/1975 | Selvin et al. . | |
| 4,008,832 | 2/1977 | Rodth . | |
| 4,028,441 | 6/1977 | Richards . | |
| 4,148,334 | 4/1979 | Richards . | |
| 4,187,262 | 2/1980 | Fessler et al. . | |
| 4,216,879 | 8/1980 | McMillin . | |
| 4,225,537 | 9/1980 | Martonffy . | |
| 4,265,376 | 5/1981 | Skidell . | |
| 4,285,977 | 8/1981 | Yezek . | |
| 4,304,736 | 12/1981 | McMillin et al. . | |
| 4,376,496 | 3/1983 | Sedam et al. . | |
| 4,399,744 | 8/1983 | Ogden . | |
| 4,451,155 | 5/1984 | Weber et al. | 261/91 |
| 4,466,342 | 8/1984 | Basile . | |
| 4,471,631 | 9/1984 | Anstey . | |
| 4,475,448 | 10/1984 | Shoaf et al. . | |
| 4,493,441 | 1/1985 | Sedam et al. . | |
| 4,520,950 | 6/1985 | Jeans . | |
| 4,555,371 | 11/1985 | Jeans . | |
| 4,597,509 | 7/1986 | Pereira . | |
| 4,635,824 | 1/1987 | Gaunt . | |
| 4,636,337 | 1/1987 | Gupta et al. . | |
| 4,643,852 | 2/1987 | Koslow | 261/DIG. 7 |
| 4,656,933 | 4/1987 | Aschberger et al. . | |
| 4,660,741 | 4/1987 | Kirschner et al. . | |
| 4,676,283 | 6/1987 | Caldwell . | |
| 4,679,701 | 7/1987 | Ackermann et al. . | |
| 4,687,120 | 8/1987 | McMillin . | |
| 4,688,701 | 8/1987 | Sedam . | |
| 4,695,468 | 9/1987 | Boston . | |
| 4,711,379 | 12/1987 | Price . | |
| 4,730,463 | 3/1988 | Stanfill . | |

(List continued on next page.)

FOREIGN PATENT DOCUMENTS

| | | |
|---|---|---|
| 1441658 | 7/1973 | United Kingdom . |

*Primary Examiner*—Tim Miles

*Attorney, Agent, or Firm*—Kelly, Bauersfeld & Lowry

[57] ABSTRACT

An improved water carbonator system is provided for thoroughly mixing a carbonating gas with a water supply flowing through a refrigerated reservoir of the type used in soft drink dispenser stations and the like. The carbonator system includes water and gas injector nozzles disposed generally at an upper end of the reservoir, together with a dispense valve for drawing carbonated chilled water from a lower end of the reservoir. A vertically elongated and rotatably driven impeller shaft carries a spaced plurality of vaneless impeller disks for causing the water flowing downwardly through the reservoir to undergo a plurality of directional changes in a radially outward direction. Such directional changes in flow result in improved intermixing with the carbonating gas and improved chilling of the water prior to dispensing.

9 Claims, 2 Drawing Sheets

U.S. PATENT DOCUMENTS 4,732,297 3/1988 Schroeder, Jr. .
4,759,474 7/1988 Regunathan .
4,764,315 8/1988 Brusa .
4,766,001 8/1988 Mizandjian et al. ..... 261/DIG. 7
4,781,309 11/1988 Vogel .
4,793,515 12/1988 Shannon et al. .
4,801,048 1/1989 Credle, Jr. et al. .
4,804,112 2/1989 Jeans .
4,808,346 2/1989 Strenger .
4,808,348 2/1989 Rudick et al. ..... 261/DIG. 7
4,836,414 6/1989 Credle, Jr. et al. .
4,850,269 7/1989 Hancock et al. .
4,859,376 8/1989 Hancock et al. .
4,866,949 9/1989 Rudick .
4,899,911 2/1990 Rohde et al. .
4,915,261 4/1990 Strenger .

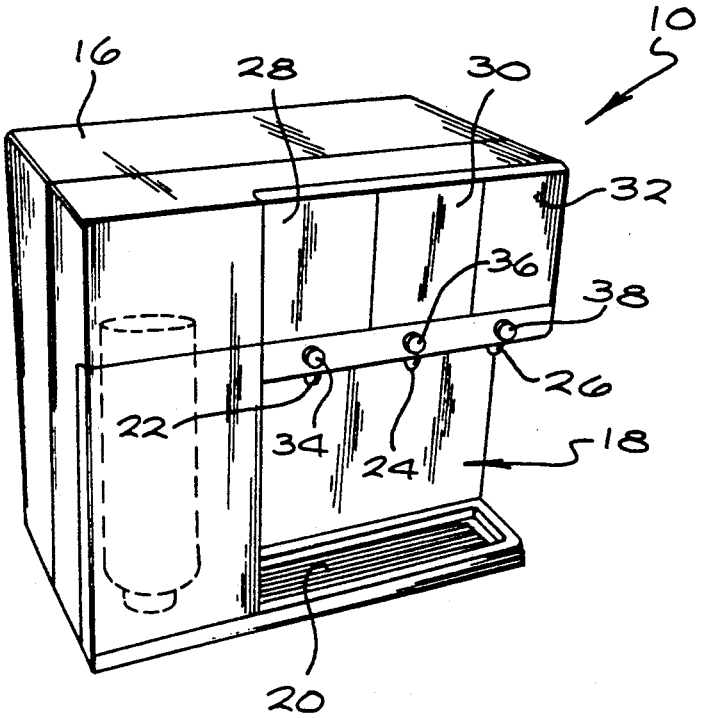
FIG. 1
FIG. 2
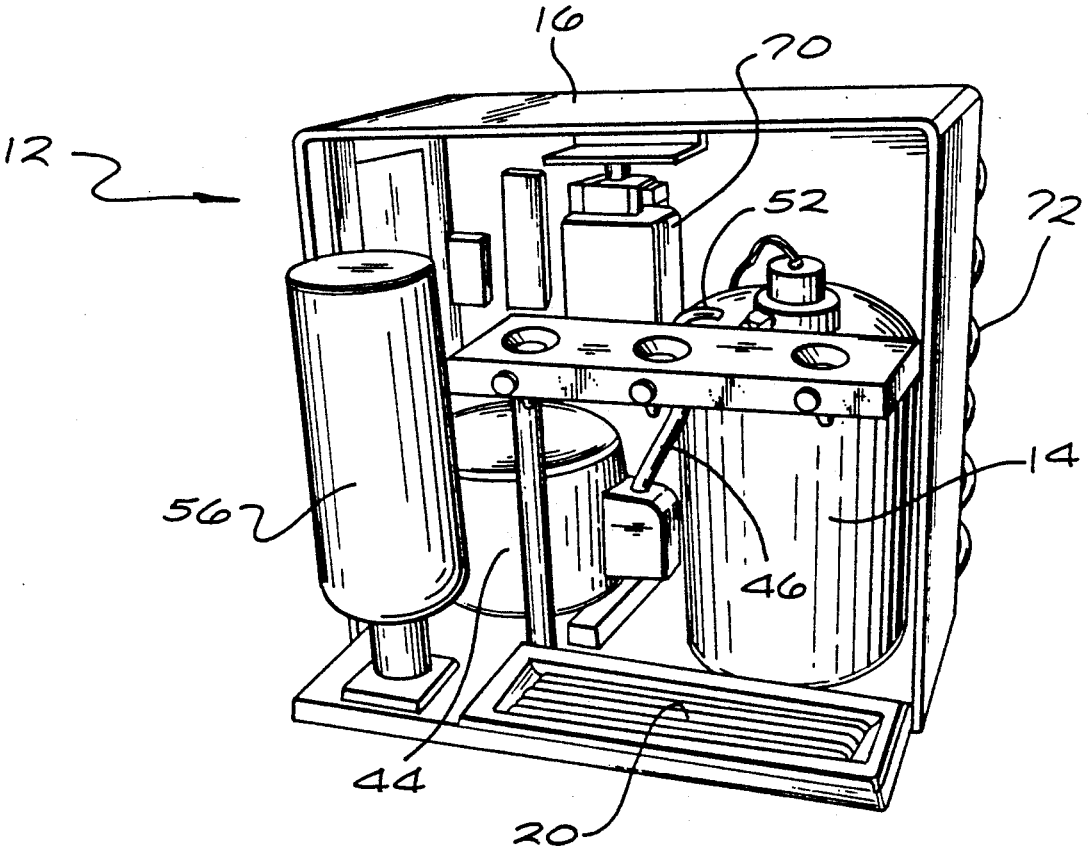

WATER CARBONATOR SYSTEM

BACKGROUND OF THE INVENTION

This invention relates generally to improvements in devices and systems for carbonating and chilling water, particularly with respect to dispenser stations and/or vending machines and the like for use in mixing and dispensing chilled carbonated beverages. More specifically, this invention relates to an improved carbonator system designed for more efficient gas-water mixing and chilling of the resultant beverage.

Carbonated water systems are generally known in the art for mixing a carbonating gas, such as carbon dioxide gas, with a fresh water supply to producing a highly pleasing and refreshing carbonated beverage which is often mixed in suitable proportion with a flavored syrup or the like. Such carbonator systems are often employed in soft drink dispenser stations and/or vending machines or the like and are adapted to dispense the carbonated soft drink beverage in individual servings, typically on the order of 6–8 ounce servings. In this form, the system typically includes a water reservoir adapted to receive fresh water from a tap water or similar source, with the reservoir being encased within surrounding cooling coils of a mechanical refrigeration unit such that the water within the reservoir is chilled to desired low temperature. The carbonating gas is supplied to the reservoir at a regulated pressure for intermixing with the chilled water to produce the carbonated beverage. Injectors and/or stirring agitator devices are often employed to enhance gas-liquid intermixing. A dispenser valve is normally provided for dispensing the beverage from the reservoir, typically in coordinated operation with a refill valve such that a volume of water dispensed from the reservoir is concurrently replaced by a fresh volume from the water source.

Although carbonated water systems of the above-described general type have achieved relatively broad commercial use, a variety of problems and disadvantages are present. For example, to achieve adequate chilling of the water within the reservoir, it has been necessary to construct and operate the refrigeration unit in a manner producing an annular ice block or ice ring within the reservoir at the periphery thereof. The presence of this ice ring effectively reduces the overall available volume of the water reservoir which, in an optimized system, is designed to be relatively compact to minimize power requirements of the refrigeration unit. Unfortunately, as a result, the residence time of a given water volume within the reservoir may be reduced such that achieving the desired low temperature level of the final beverage becomes difficult or impossible when several servings are dispensed at close time intervals. Moreover, a refill volume of water entering the reservoir may be subjected to a relatively direct and undesired flow path through the center of the ice ring between a reservoir inlet and dispensing outlet. Achieving the desired low temperature of the final beverage is further complicated by the fact that the carbonated water is often mixed during dispensing with a proportional quantity of a selected flavor syrup which, if not separately refrigerated, acts to warm the already inadequately chilled carbonated water.

There exists, therefore, a significant need for further improvements in carbonated water systems for use in preparing and dispensing carbonated beverages, wherein the residence time of each refill water volume within a refrigerated reservoir is increased to achieve substantially improved chilling and concurrent gas mixing despite dispensing of multiple servings in rapid succession, and further wherein the development of a reservoir ice ring and/or the need for separate syrup refrigeration are substantially eliminated. The present invention fulfills these needs and provides further related advantages.

SUMMARY OF THE INVENTION

In accordance with the invention, an improved water carbonator system is provided for use in the efficient production of chilled carbonated water. The system includes an improved mixing impeller arrangement within a refrigerated refillable water reservoir for forcing the water to flow along a tortuous, direction-changing path during passage from a water inlet to a dispensing outlet. As a result, the water encounters improved intermixing with a carbonating gas and improved heat transfer for chilling purposes.

In the preferred form, the reservoir includes separate injector nozzles at one end thereof for the respective introduction of water and carbonating gas, such as carbon dioxide gas into the reservoir interior. Cooling coils of a mechanical refrigeration unit are wrapped about the reservoir to chill the water therein. A dispensing valve permits selective drawing of the chilled carbonated water from the reservoir via a dispensing outlet disposed generally at an opposite end of the reservoir from the injector nozzles. The dispensing valve may be associated with a separate supply of a flavor syrup or the like and may include or be associated with an appropriate mixing valve for proportionately mixing the syrup with the carbonated water during dispensing. In a typical arrangement, the injector nozzles are located at an upper end of the reservoir, and the dispensing outlet is located at a lower end of the reservoir. The improved mixing impeller is mounted generally centrally within the reservoir and includes a plurality of spaced impeller disks for redirecting water flow passing generally downwardly through the reservoir.

More specifically, the mixing impeller comprises an elongated impeller shaft extending generally vertically through a central region of the reservoir. The shaft is adapted to be rotatably driven about its own axis, with a preferred drive means including a suitable drive motor mounted outside the reservoir and operably connected to the shaft via a hermetically sealed magnetic coupling or the like. The impeller disks are mounted on the shaft for rotation therewith and preferably comprise vaneless disks to permit rotational driving thereof with minimal power consumption. These disks each redirect the general downflow direction of the water to a radially outward direction, with the resultant multiple directional flow changes providing significantly improved water residence time and chilling efficiency as well as improved gas-liquid mixing.

Other features and advantages of the present invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings:

FIG. 1 is a front perspective view of a soft drink dispenser station including the improved water carbonator system embodying the novel feature of the invention;

FIG. 2 is a front perspective view of the dispenser station of FIG. 1, with frontal portions of station housing structures removed to expose components of the carbonator system.

DETAILED DESCRIPTION OF THE PREFERRED EMBODIMENT

Figure 3:
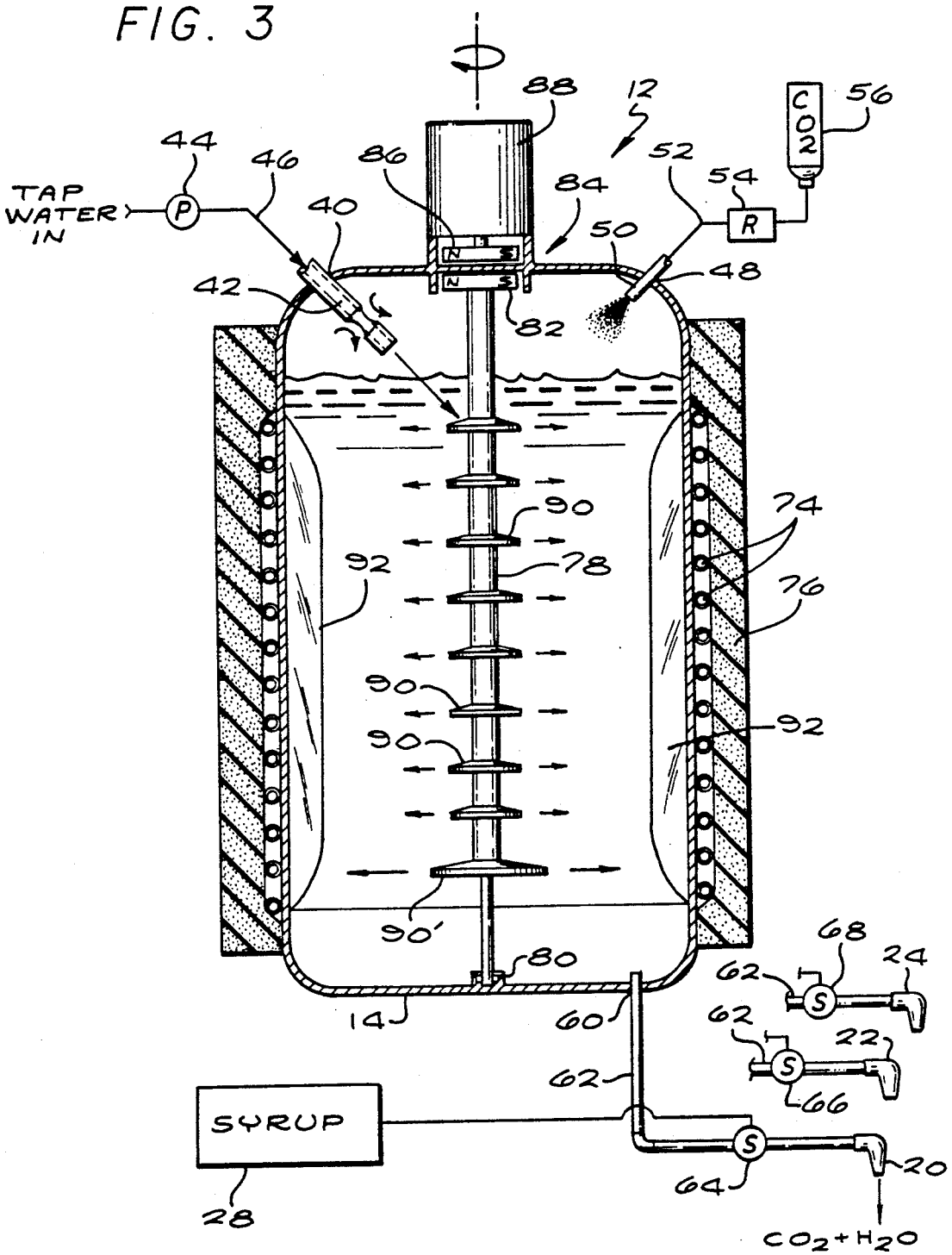
FIG. 3 is an enlarged and somewhat schematic vertical sectional view depicting the construction and operation of a refrigerated and refillable water reservoir forming a primary feature of the invention.

As shown in the exemplary drawings, an improved water carbonator system is provided for use in a soft drink dispenser station or the like, as referred to generally by the reference numeral 10 in FIGS. 1 and 2. The carbonator system 12, shown in best detail in FIG. 3, includes an improved yet relatively simple impeller arrangement which provides significant improvements in water chilling efficiency in addition to improved intermixing with a carbonating gas.

The water carbonator system is particularly designed for use with beverage dispenser stations, vending machines, etc., of a type wherein carbonated water in a chilled state is drawn off or dispensed in individual servings, typically by dispensing the beverage into a cup (not shown) of an approximate 8–12 ounce capacity. Each time an individual serving is dispensed, a reservoir 14 forming an integral portion of the system 12 is refilled with a fresh volume of water to be carbonated and chilled in preparation for subsequent dispensing. By providing improved thermal efficiency for better chilling in combination with improved gas-liquid mixing, the present invention enables the system 12 to employ a smaller volume reservoir 14 with reduced refrigeration energy consumption. Moreover, when the carbonated chilled water is subsequently mixed with a flavor syrup or the like, the present invention beneficially provides an optimally chilled final beverage without requiring separate syrup refrigeration. The overall costs of the dispenser station 10 in terms of equipment and operating costs are thus reduced.

As shown generally in FIGS. 1 and 2, the illustrative dispenser station 10 includes a housing 16 which may be sized and shaped for a convenient and compact countertop installation. The exemplary housing 16 defines a forwardly open receptacle 18 having a shelf 20 for receiving a drinking cup (not shown) or the like in a filling position disposed immediately below any one of three separate dispensing nozzles 22, 24 and 26. These nozzles 22, 24 and 26 are respectively associated with a corresponding number of syrup containers 28, 30 and 32 (FIG. 1) adapted for removable mounting into the station housing 16. In addition, the nozzles 20, 22 and 24 are further associated with individual dispense actuators such as the illustrative dispense buttons 34, 36 and 38. While three dispense nozzles and related components are shown in the accompanying drawings, it will be understood that the present invention is applicable to any system having at least one dispense nozzle.

As shown in FIG. 2, the reservoir 14 comprises a relatively compact tank adapted for installation into the interior of the station housing 16. The reservoir includes an upper water inlet 40 (FIG. 3) having a suitable injector nozzle 42 mounted therein, with a pump 44 (FIG. 2) or other suitable regulatory device being mounted within the housing 16 and connected to the water inlet 40 via a conduit 46. As is known in the art, the pump or device 44 functions to regulate the flow of water from a suitable tap or bottled water source to the reservoir.

The water inlet 40 is shown generally at the upper end of the reservoir 14 in a position adjacent to a gas inlet 48 having a suitable gas nozzle 50 mounted therein. As is known in the art, the nozzle 50 supplies the carbonating gas into the interior of the reservoir for intermixing with the water therein. In a typical system, the nozzle 50 is connected via a conduit 52 and pressure regulator 54 to a cartridge 56 containing a supply of carbon dioxide gas under pressure. The regulator 54 maintains a gas volume 58 within the reservoir 14 at a substantially constant pressure level, and the cartridge 56 may be conveniently adapted for easy replacement installation within the station housing 16. Alternately, the gas nozzle 50 can introduce the gas into the reservoir interior at any convenient location.

The carbonator system 12 further includes a dispensing outlet 60 positioned to open into the reservoir 14 at a position generally opposite the water and gas nozzles. The dispensing outlet 60 is coupled via an appropriate parallel flow network of conduits 62 (FIG. 3) to mixing and dispensing valves 64, 66 and 68 associated respectively with the dispensing nozzles 20, 22 and 24. These dispensing valves have a conventional construction known in the art for selective opening in response to depression of the buttons 34, 36 and 38 (FIG. 1) to draw the carbonated water from the reservoir 14, and to mix the carbonated water with a proportional quantity of flavor syrup from the containers 28, 30 and 32.

A conventional refrigeration unit is additionally provided for chilling the carbonated water within the reservoir 14. As shown in FIG. 2, the refrigeration unit includes an appropriate mechanical compressor 70 and related condenser coils 72 for supplying refrigerant to cooling coils 74 wrapped spirally about the reservoir 14. An insulation blanket 76 (FIG. 3) is normally wrapped in turn about the coils 74 to minimize thermal losses.

In accordance with the primary aspect of the invention, the improved impeller arrangement includes a vertically elongated impeller shaft 78 mounted at a generally centered position within the reservoir 14. A lower end of this shaft is seated within a bearing seat 80 at a lower end of the reservoir. An upper end of the impeller shaft carries a driven component 82 of a magnetic drive coupling 84, the drive component 86 of which is disposed outside the reservoir and is rotatably driven by a small drive motor 88. Accordingly, the impeller shaft 78 is driven by the magnetic coupling 84 for rotation about the vertically oriented shaft axis, while maintaining the coupling components in hermetically sealed relation.

A plurality of impeller disks 90 are mounted along the length of the impeller shaft 78 in vertically spaced relation to each other. These impeller disks 90 are rotatably driven with the impeller shaft and function to pump the water in a radially outward direction toward the periphery of the reservoir 14, and thus into closer proximity with the cooling coils 74 for improved heat transfer therewith. The cooperative effect of the multiple impeller disks 90 provides a multitude of directional flow changes to the water, with a corresponding significant increase in heat transfer for chilling, and associated improved gas intermixing. Moreover, the radially outward water flows tend to prevent formation of and/or otherwise minimize the size of any annular ice ring 92 at the reservoir periphery, while correspondingly improving overall heat transfer for chilling by disrupting any cold fluid boundary layer alongside the ice ring.

In the preferred form, for minimum power consumption, the impeller disks 90 are vaneless. This permits the disks to be rotated with minimal torque and with use of a relatively small drive motor 88. If desired, the lowermost disk 90' may be formed with a comparatively enlarged diameter size. Moreover, as shown, the water injector 42 desirably includes a venturi construction to entrain gas with the incoming water stream for better carbonation.

The resultant carbonated water at the lower end of the reservoir is thus chilled with maximum efficiency, and/or through the use of a relatively small capacity refrigeration unit. The final beverage at the dispense nozzles will have a desired low temperature, without requiring further refrigeration of a flavor syrup added thereto. Moreover, repeated and rapid servings can be accommodated while maintaining the reservoir water at the desired chilled state.

A variety of modifications and improvements to the water carbonator system of the present invention will be apparent to those persons skilled in the art. Accordingly, no limitations on the invention are intended by way of the foregoing description and accompanying drawings, except as set forth in the appended claims.

What is claimed is:

1. A water carbonator system, comprising:

a generally upright reservoir having upper and lower ends;

means for introducing water into said reservoir via a water inlet disposed generally at one of said upper and lower ends of said reservoir;

means for introducing a selected carbonating gas into said reservoir for mixture with the water therein to form carbonated water;

an elongated impeller shaft extending generally centrally and vertically within said reservoir;

means for rotatably supporting said shaft for rotation about its own axis within said reservoir;

drive means for rotatably driving said shaft about its own axis;

a plurality of vaneless impeller disks carried on said shaft in vertically spaced relation for rotation therewith;

refrigeration means including cooling coils mounted about the periphery of said reservoir to chill water within said reservoir; and dispensing outlet means disposed generally at the other of said upper and lower ends of said reservoir for drawing the chilled carbonated water from said reservoir, said disks upon rotation of said shaft each pumping the water in the vicinity thereof in a generally radially outward direction toward the periphery of said reservoir into close heat exchange proximity with said cooling coils to chill the water, whereby said disks collectively pump water introduced into said reservoir into close heat exchange proximity with said cooling coils a plurality of times as such water travels between said upper and lower reservoir ends and before such water is drawn from said reservoir by said dispensing outlet means, and further whereby said disks collectively provide a plurality of radially outwardly directed water flows within said reservoir to minimize ice ring formation within said reservoir at the periphery thereof.

2. The water carbonator system of claim 1 wherein said water introducing means comprises a water injector nozzle.

3. The water carbonator system of claim 1 wherein said drive means comprises a drive motor disposed outside said reservoir, and hermetically sealed coupling means for connecting said drive motor to said impeller means.

4. The water carbonator system of claim 3 wherein said coupling comprises a magnetic coupling for drivingly connecting said motor with said impeller shaft.

5. The water carbonator system of claim 1 wherein said water introducing means introduces the water into said reservoir generally at said upper end thereof.

6. The water carbonator system of claim 5 wherein said gas introducing means introduces the gas into said reservoir generally at said upper end thereof.

7. The water carbonation system of claim 1 wherein said dispensing outlet means includes a dispensing valve adapted for movement between open and closed positions.

8. The water carbonator system of claim 7 further including a source of flavor syrup, said dispensing valve further including means for mixing said syrup in selected proportion with carbonated water drawn from said reservoir.

9. The water carbonator system of claim 8 wherein said source of flavor syrup is unrefrigerated.

* * * * *